United States Patent [19]

Zehler

[11] Patent Number: 5,047,159

[45] Date of Patent: Sep. 10, 1991

[54] LUBRICANT COMPOSITIONS HAVING IMPROVED ANTI-DEPOSITION PROPERTIES COMPRISING A POLYALKYLENE OXIDE-MODIFIED SILICONE OIL

[75] Inventor: Eugene R. Zehler, West Chester, Ohio

[73] Assignee: Henkel Corporation, Ambler, Pa.

[21] Appl. No.: 398,196

[22] Filed: Aug. 24, 1989

[51] Int. Cl.[5] ..... C10M 155/02

[52] U.S. Cl. ..... 252/49.6; 252/56.S

[58] Field of Search ..... 252/565, 49.6

[56] References Cited

U.S. PATENT DOCUMENTS

| | | | |
|---|---|---|---|
| 3,117,149 | 1/1964 | Holdstock | 252/49.6 |
| 3,180,831 | 4/1965 | Wisotsky | 252/42.7 |
| 3,280,160 | 10/1966 | Bailey | 252/42.7 |
| 3,457,173 | 7/1969 | Pater | 252/49.6 |
| 3,538,001 | 11/1970 | Gothel et al. | 252/49.6 |
| 3,816,313 | 6/1974 | Szieleit | 252/49.6 |
| 4,324,720 | 4/1982 | Swilhart | 252/49.6 |
| 4,420,409 | 12/1983 | Fukano et al. | 252/49.6 |
| 4,549,004 | 10/1985 | von Aze | 252/42.7 |
| 4,589,990 | 5/1986 | Zehler | 252/56 |
| 4,652,386 | 3/1987 | Alberts | 252/42.7 |
| 4,698,178 | 10/1987 | Hüller | 252/309 |
| 4,844,826 | 4/1989 | Schaefer | 252/49.6 |

FOREIGN PATENT DOCUMENTS

| | | |
|---|---|---|
| 0176884 | 4/1986 | European Pat. Off. . |
| 1371956 | 10/1974 | United Kingdom . |

OTHER PUBLICATIONS

Union Carbide Corporation, Silwet® Surfactants, U.S.A., 1988, pp. 1–12, 21.

*Primary Examiner*—Prince E. Willis
*Assistant Examiner*—Jerry D. Johnson
*Attorney, Agent, or Firm*—Ernest G. Szoke; Wayne C. Jaeschke; John E. Drach

[57] ABSTRACT

Lubricant compositions having improved anti-deposition properties through the addition of effective amounts of polyalkyleneoxide-modified silicone oils. The silicone oils have pendant polyether groups bonded to the silicon chain by non-hydrolyzable Si-C bonds. The silicone oils have molecular weights in the range of about 200 to about 5000 g/mole.

26 Claims, No Drawings

LUBRICANT COMPOSITIONS HAVING IMPROVED ANTI-DEPOSITION PROPERTIES COMPRISING A POLYALKYLENE OXIDE-MODIFIED SILICONE OIL

FIELD OF THE INVENTION

The invention relates to lubricant compositions having reduced tendency to form carbonaceous deposits on working surfaces.

BACKGROUND OF THE INVENTION

Lubricants are used primarily to reduce friction and wear on parts which move in contact with each other. Also, lubricant compositions serve to transfer heat from moving parts. Lubricants are compounded from stable component materials to maximize the useful life of the lubricant. The component materials include representative basestocks such as petroleum, synthetic esters, hydrocarbon-based polymers, silicone fluids, polyglycols, polyphenyl ethers, phosphate esters, and alkyl benzenes as well as other fluids known in the art. A wide number of additives are also employed, such as antioxidants, viscosity improvers, corrosion inhibitors, antiwear agents, and the like. However, under high temperature operating conditions, the lubricant, comprised of a basestock and one or more additives, tends to break down by any one of several degradative mechanisms, such as oxidation, polymerization or the like. As a result, the working surfaces, typically metal, which come in contact with the lubricant composition tend to become coated with carbonaceous deposits. In time, these deposits form a smooth varnish-like coating which adheres tenaciously to the working surfaces, necessitating solvent treatment in an effort to remove the varnish. Alternatively, the deposits appear as a velvet-like coating which is less tenacious but still requires scraping or solvent treatment for removal.

Deposits of these types occur on working surfaces in a variety of applications where lubricant compositions are employed. One such application is chain lubrication. Chain lubricants are used to protect chains and bearings in ovens, furnaces and kilns. The lubricant compositions are usually applied by brush, spray, drip operation, wheel, or bath immersion. During operation, the lubricant is carried along on a belt or chain which moves from a low temperature area to a higher temperature area and back. Thus, the lubricant is continuously cycled through one of a range of temperatures over a range of cycling periods. Chain lubricants are employed in machinery used in various high temperature operations, such as plywood drying, glass forming, paint curing, lithography, annealing, tempering, and baking.

As the maximum operating temperature for the oven, furnace or kiln increases, and as the period of exposure to high temperature increases, the degradation rate of the chain lubricant composition accelerates. Likewise, the formation of carbonaceous deposits on the working surfaces also accelerates. The deposits add to the weight of the chain, impair the flexibility of the chain, and increase the power draw on the drive motor. The deposit is typically inspected visually and deposits are removed where possible by scraping, brushing, or solvent action. When the deposit builds up to an unacceptable extent and cannot be removed, the chain is discarded.

Deposit formation occurs in all lubrication environments where the operating conditions are sufficient to promote breakdown of the lubricant composition components. The problem of carbonaceous deposit formation exists in a variety of other applications requiring lubricants, such as in crankcase lubrication, turbine lubrication, compressor lubrication, gear lubrication, bearing lubrication, and the like.

BRIEF DESCRIPTION OF THE INVENTION

It has been discovered that a silicone based compound having pendant polyether groups, when added to a lubricant composition in an effective amount, can provide a significant reduction of deposits on the surfaces which come in contact with the lubricant composition under high temperature conditions. The silicone compound is a polyalkyleneoxide-modified silicone oil, which contains pendant polyether groups bonded to the silicon chain through a non-hydrolyzable silicon-carbon bond. The oil has a molecular weight in the range of 200 to 5000 g/mole. One source of these oils is the Union Carbide Corporation, which commercially produces the oils as the "SILWET" series of surface active copolymers.

The silicone oils described herein improve the anti-deposition properties of a variety of basestocks. The polyalkyleneoxide-modified silicone oil has been found to be particularly useful when combined with basestock blends of a polyol ester and polybutene polymer. The silicone oil additive also improves the anti-deposition properties of basestock comprised almost entirely of polyalphaolefin, polyol ester, trimellitate ester, petroleum based fluid, as well as a variety of other synthetic basestock fluids such as, but not limited to, diesters, polyolefins and complex esters.

It is therefore an object of this invention to provide a lubricant composition having a polyalkyleneoxide-modified silicone oil additive which improves the anti-deposition properties of the lubricant composition.

It is a further object to provide a lubricant composition comprised of a basestock blend of polyol ester and polybutene polymer combined with a polyalkyleneoxide-modified silicone oil to reduce deposits on working surfaces.

It is yet a further object to provide a lubricant composition having improved anti-deposition properties for use as a chain lubricant.

It is yet a further object to provide lubricant compositions comprised of a polyalkyleneoxide-modified silicone oil in admixture with one or a variety of synthetic and petroleum basestocks.

DETAILED DESCRIPTION OF THE INVENTION

The invention in its broader aspects relates to a lubricant composition having improved anti-deposition characteristics comprising a basestock which is selected from the group consisting of at least one fluid synthetic ester, at least one fluid polyolefin, at least one petroleum-derived lubricant fluid, and mixtures thereof; and a polyalkyleneoxide-modified silicone oil of the general formula $$(CH_3)_3SiO[(CH_3)_2SiO]_x(CH_3\underset{\underset{CH_2CH_2CH_2O(EO)_m(PO)_nZ}{|}}{SiO})_ySi(CH_3)_3$$

wherein EO is ethyleneoxy, PO is 1,2-propyleneoxy, Z is either hydrogen or a lower alkyl radical of up to about 5 carbons, $x \geqq 0$, $y \geqq 1$, and m and n are integers, the sum of m+n being at least 1, the silicone oil added in an amount effective to improve the anti-deposition properties of the composition. Preferably, the silicone oil is added at a level of from about 0.1 to about 3.0% by weight of the lubricant composition.

The polyalkyleneoxide-modified silicone oils used in this invention are of the type manufactured by the Union Carbide Corporation under its "SILWET" series of surface active copolymers. The "SILWET" surface active copolymers are dimethyl silicone polymers which contain pendant polyether groups. The copolymers having utility within the scope of this invention have the polyether groups attached to the silicone backbone through non-hydrolyzable silicon-carbon linkages. The useful silicone oils of this invention have molecular weights in the range of about 200 to about 5000 g/mole, and preferably in the range of about 400 to about 1500 g/mole The "SILWET" copolymers which produce improved anti-deposition characteristics in lubricant compositions are described in promotional literature as being surfactants or wetting agents. Representative "SILWET" copolymers used according to the teachings of this invention are listed below with their physical properties.

TABLE I

"SILWET" Copolymers

| Copolymer | Apparent Specific Gravity, 25/25° C. | Surface Tension at 25° C. dynes/cm | Viscosity at 25° C. cSt |
|---|---|---|---|
| L-77 | 1.007 | 24.1 | 20 |
| L-7600 | 1.066 | 24.5 | 130 |
| L-7607 | 1.030 | 25.2 | 45 |
| L-7500 | 0.987 | 23.1 | 175 |

| Copolymer | Surface Tension 1% in $H_2O$ at 25° C. dynes/cm | Molecular Weight | Pendant Polyether Group* |
|---|---|---|---|
| L-77 | 20.7 | 600 | EO,-Methyl |
| L-7600 | 24.9 | 4,000 | EO,-Methyl |
| L-7607 | 22.4 | 1,000 | EO,-Methyl |
| L-7500 | — | 3,000 | PO,-Butyl |

Source: Union Carbide "SILWET" Surfactants brochure, © 1988 Union Carbide Corporation, and Union Carbide "Silicone Fluids" brochure, © 1978, 1980, 1982.
*EO = Ethyleneoxy; PO = propyleneoxy; the Methyl and Butyl groups refer to the terminating alkyl groups on the pendant polyether, corresponding to the "Z" component of the silicone oil general formula described herein.

The lubricant compositions described herein which contain the polyalkyleneoxide-modified silicone oils of this invention exhibit decreased residue build-up on metal surfaces. The tendency of a lubricant composition to form carbonaceous deposits on working surfaces was measured using a Panel Coke Test, which is a modification of the United States Steel Method utilizing Federal Standard Apparatus 3462-T as further described below. Specifically, this test measures the coking tendency of oil.

Lubricant composition basestocks which exhibit improved anti-deposition characteristics with added "SILWET" silicone oils include polyol esters diesters, triesters, complex esters, polyolefins, and petroleum fluids. The esters have 40° C. viscosities in the range of 5 to 300 centistokes. Preferably, the ester viscosities are in the range of 20 to 250 centistokes. The polyolefins encompass those fluids such as polyalphaolefins and low molecular weight polybutenes, which have utility as a basestock without the need for additional blending, as well as higher molecular weight polybutenes, polyisobutylenes and the like, which are used typically in admixture with other basestock fluids to alter viscosity. Also encompassed are mixtures of polyolefins. The petroleum fluids are refined petroleum fractions having 40° C. viscosities in the range of 15 to 450 cSt.

The polyolefins are derived from monomers having chain lengths from $C_2$ through $C_{20}$, and the polymer has a weight average molecular weight in the range of 250 to 10,000. The polyolefin polymer can be hydrogenated or unhydrogenated, and is intended to encompass compounds such as polyalphaolefins, polybutenes, and polyisobutylenes, as well as other polymeric olefins.

Polyol esters which can be used are derived from aliphatic polyols having from 3 to 12 carbon atoms and 2 to 8 hydroxyl groups. More generally, the polyol will contain 5 to 8 carbon atoms and 2 to 6 hydroxyl groups. Illustrative aliphatic polyols of the above types include neopentyl glycol, 2,2-dimethyl-3-hydroxypropyl-2,2-dimethyl-3-hydroxypropionate, 2,2,4-trimethyl-1,5-pentanediol, trimethylolethane, trimethylolpropane, glycerol, pentaerythritol, dipentaerythritol, tripentaerythritol or the like. Technical pentaerythritol which contains mono, di-, tri- and higher pentaerythritols in varying proportions can also be used. The polyols are reacted, partially or completely, with an aliphatic monocarboxylic acid or mixture of aliphatic monocarboxylic acids having from 5 to 20 carbon atoms. The $C_{5-20}$ aliphatic monocarboxylic acids can be branched or straight-chain and may be saturated or can contain unsaturation. They can be obtained from natural fats or oils or synthetically produced via oxo, Koch or other known reactions. Illustrative aliphatic monocarboxylic acids include valeric acid, isovaleric acid, caprylic acid, pelargonic acid, capric acid, lauric acid, myristic acid, palmitic acid, isopalmitic acid, stearic acid, isostearic acid, ricinoleic acid, oleic acid, linoleic acid, and mixtures thereof. Mixed acids derived from coconut oil, lard oil, tall oil, safflower oil, corn oil, tallow, soybean oil, palm oil, castor oil, rapeseed oil, and the like may also be utilized. Polyol esters obtained from the esterification of technical pentaerythritol with $C_{6-9}$ aliphatic monocarboxylic acids or mixtures thereof are particularly useful for the preparation of the present lubricant compositions. The polyol esters typically have acid values less than 15 and hydroxyl values less than 100. More usually, acid and hydroxyl values of the polyol ester will be less than 5 and less than 10, respectively.

Useful diesters are obtained from dicarboxylic acids having from 6 to 36 carbon atoms and monofunctional alcohols having from 8 to 20 carbon atoms. The dicarboxylic acids may be straight or branched chain alkyl or alkenyl, as well as aryl. Illustrative acids are adipic, sebacic, azelaic, phthalic, and dimer. The aliphatic alcohols may be a straight-chain or branched primary, secondary or tertiary alcohol. Illustrative alcohols include n-octyl alcohol, capryl alcohol, isooctanol, 2-ethylhexanol, decyl alcohol, isotridecyl and isodecyl alcohols, lauryl alcohol, myristyl alcohol, cetyl alcohol, and the like.

Useful triesters are obtained from trimellitic acid, trimellitic anhydride, or trimer acid and aliphatic monofunctional alcohols having from 8 to 16 carbon atoms. Trimellitic acid, trimellitic anhydride and trimer acid are, of course, well known chemical products as are methods for their preparation. The aliphatic alcohols may be a straight-chain or branched primary, secondary, or tertiary alcohol. Illustrative alcohols include n-octyl alcohol, capryl alcohol, isooctanol, 2-ethylhexanol, decyl alcohol, isotridecyl and isodecyl alcohols, lauryl alcohol, myristyl alcohol, cetyl alcohol, and the like. Especially advantageous triesters are derived from $C_{10-13}$ aliphatic alcohols or alcohol mixtures. Isodecyl trimellitate, isotridecyl trimellitate and mixtures thereof, i.e., isodecyl/isotridecyl trimellitate, are particularly useful esters of this type. Acid values of these esters are generally less than 15 and, more preferably, less than 5. Hydroxyl values are typically less than 10 and, more preferably, less than 3.

Complex esters which can be used are derived from combinations of mono- and polyfunctional alcohols and fatty acids. Typically, monofunctional and polyfunctional alcohols of the type described above are combined with one or more mono-, di- and polycarboxylic acids having from 5 to 54 carbon atoms. For example, complex esters can be prepared by combining a polyol with a blend of monocarboxylic and dicarboxylic acids.

In addition to the silicone oil, performance additives are typically incorporated into the lubricant composition. The number, type and amount of additives are dependent on the ultimate end use of the lubricant composition. The following general types of additives can be used alone or in combination: antioxidants, antiwear agents, extreme pressure agents, rust and corrosion inhibitors, metal deactivators, dispersants, detergents, anti-foamants, demulsifiers, emulsifiers, friction modifiers, tackifiers, thickeners and dyes. A non-comprehensive listing of specific examples of these and other additives is disclosed in U.S. Pat. No. 4,589,990, which is incorporated herein by reference.

The lubricant compositions of this invention were easily prepared by combining all components and then heating with agitation to about 90° C. until the blend was uniform. After cooling of the mixture to approximately 70° C., the contents were filtered through 10 micron filter paper and allowed to stand.

The coking tendency of the lubricant composition was evaluated using the Panel Coke Test. The test procedure was modified from the Federal Test Method 791 B 3462, and employed the Federal Standard Apparatus 3462-T. The apparatus consists of a closed reservoir attached to a runway for retaining a test panel. The apparatus has electric elements for heating the test panel which are able to maintain the test panel at a specific temperature for an extended length of time. Above the reservoir is positioned a horizontal shaft having four spaced wires which run at right angles thereto. In operation, the spaced wires dip into the oil held in the reservoir. The oil is then splashed by the wires onto an aluminum test panel positioned above the shaft and at an angle thereto for a period of time as the shaft rotates. For testing chain lubricants, the panel is splashed for approximately six hours. For other other lubricants, the time period is four hours.

In actual operation, 265 milliliters of the test oil was charged into the reservoir. Then, a tared aluminum test panel was placed on a runway above the oil reservoir and tightened. Into a graduate cylinder was stored an additional 125 milliliters of test oil which was made automatically available to the reservoir to replace test oil lost over the span of the test due to volatilization, degradation, leakage or the like. The panel was then heated to 650° F. (343° C.). At the start of the panel heat-up, the motor connected to the splasher shaft was turned on, which rotated the shaft at 1000±50 rpm. After an approximate 15 minute period to reach temperature equilibration on the test panel, the test was run for an additional six hours in the case of chain lubricants, and four hours for other lubricants. During the test period, the splasher wires were throwing oil continuously onto the test panel. After the test period, the panel was removed, cooled, and washed in hexane, dried and weighed. The difference in weight (weight gain) was reported as the coking value.

OPERATING EXAMPLES

The following examples demonstrate the improved anti-deposition properties of various lubricant compositions through the use of an effective amount of a polyalkyleneoxide-modified silicone oil, which preferably comprises in the range of 0.1 to 3.0% by weight of the lubricant composition. Depending on the formulation, one or more of several silicone oils were utilized. The silicone oils varied primarily by molecular weight, type of polyether pendant group (ethyleneoxy or propyleneoxy), and terminating alkyl group (range of one through five carbon atoms, typically methyl or butyl).

The coking value weight is listed in milligrams and indicates the net weight gain of the test panel after completion of the Panel Coke Test. For a number of the tested panels, a qualitative appearance evaluation was also made. The appearance values are a visual evaluation of the percentage of the panel surface which is coated with a particular deposit. The Panel Coke Test values listed in this and all Tables are in weight percents, based on the entire lubricant composition.

EXAMPLES I-III

The following examples are lubricant compositions suitable for use as chain lubricants and are formulated to an ISO 150 viscosity grade. The ISO viscosity grades were developed by the International Organization for Standardization and correlate to centistoke units. An ISO 150 lubricant has a viscosity at 40° C. of 150 centistokes±10%. The polyol ester/polybutene blends producing an ISO VG (viscosity grade) 150 were combined in the weight ratio of 70% polyol ester and 30% polybutene to form the basestock for these examples. The polyol ester was the reaction product of technical pentaerythritol and $C_{6-9}$ monocarboxylic acids having an acid value (AV) of about 0.03, a hydroxyl value (OH) of about 0.6, and a 40° C. viscosity of 34.1 cSt. The polybutene had an AV of about 0.01, a 100.C viscosity of about 650 cSt, and a weight average molecular weight (Mw) of about 3200.

The compositions and coking value results, listed on the "Panel Coke Test" line, are given below.

| | Example | | |
|---|---|---|---|
| Composition | I | II | III |
| Basestock: | 96.95 | 96.45 | 96.45 |
| Performance Additives | 3.05 | 3.05 | 3.05 |
| "SILWET" L-77 | — | 0.50 | — |
| "SILWET" L-7500 | — | — | 0.50 |
| Panel Coke Test, mg (6 hrs) | 46.4 | 15.9 | 42.4 |
| Appearance: | | | |
| Clean | 5 | — | 10 |
| Light Varnish | 75 | 96 | 65 |
| Medium Varnish | — | — | 5 |
| Dark Varnish | — | — | — |
| Velvet Carbon | 20 | 4 | 20 |

EXAMPLES IV-X

The following examples are lubricant compositions for use as chain lubricants formulated to ISO VG 220, corresponding to a 40° C. viscosity of 220 centistokes±10%. These examples show the effects of the use of different "SILWET" silicone oils as well as different levels of silicone oil addition. The polyol ester/polybutene blends having an ISO VG 220 were combined in the weight ratios of 64% polyol ester and 36% polybutene to form the basestock for these examples. The polyol ester and polybutene were the same as described in Examples I-III. This series of examples also demonstrates that different silicone oils have varying degrees of efficacy in specific basestocks. Note that in Examples V-VII "SILWET" L-77 substantially reduced deposit formation relative to the control Example IV while Example X with "SILWET" L-7500 actually had a higher Panel Coke Test value. These results underscore the need for the formulator to select the silicone oil to achieve maximum performance in combination with the other components comprising the lubricant composition.

| Composition | Example IV | V | VI | VII | VIII | IX | X |
|---|---|---|---|---|---|---|---|
| Basestock: | 96.95 | 96.45 | 96.25 | 95.55 | 96.25 | 95.55 | 95.55 |
| Performance Additives | 3.05 | 3.05 | 3.05 | 3.05 | 3.05 | 3.05 | 3.05 |
| "SILWET" L-77 | — | 0.50 | 0.70 | 1.40 | — | — | — |
| "SILWET" L-7607 | — | — | — | — | 0.70 | 1.40 | — |
| "SILWET" L-7500 | — | — | — | — | — | — | 1.40 |
| Panel Coke Test, mg (6 hrs) | 56.6 | 16.4 | 13.2 | 11.0 | 45.5 | 22.4 | 57.9 |
| Appearance: | | | | | | | |
| Clean | — | — | — | — | — | — | — |
| Light Varnish | 75 | 95 | 97 | 99 | 80 | 90 | — |
| Medium Varnish | — | — | — | — | — | — | — |
| Dark Varnish | — | — | — | — | — | — | 10 |
| Velvet Carbon | 25 | 5 | 3 | 1 | 20 | 10 | 90 |

EXAMPLES XI-XII

The following examples represent lubricant compositions prepared from trimellitate ester base-stock with no added polybutene.

The trimellitate ester was the reaction product of trimellitic anhydride and an alcohol blend of isodecyl and isotridecyl alcohols. The resulting ester had an acid value of about 0.02, a hydroxyl value of about 1.8 and a 40° C. viscosity of about 220 cSt.

| Composition | Example XI | XII |
|---|---|---|
| Trimellitate Ester | 96.95 | 96.95 |
| Performance Additives | 3.05 | 3.05 |
| "SILWET" L-77 | — | 0.70 |
| Panel Coke Test, mg (6 hrs) | 36.2 | 19.8 |

EXAMPLES XIII-XVI

The following examples demonstrate the utility of the silicone oil additive combined with commercially available polyalphaolefin-based compressor lubricants. Examples XIII and XIV utilized "EMERY" 2948 ISO VG 32 compressor lubricant. Examples XV and XVI were based on "EMERY" 2950 ISO VG 100 compressor lubricant. It was determined that "SILWET" L-7500 was more compatible with the compressor lubricants than L-77, due to the increased amount of polyalphaolefin in the lubricants. Thus, L-7500 was used alone and in combination with a minor amount of L-77 rather than L-77 alone.

| Composition | Example XIII | XIV | XV | XVI |
|---|---|---|---|---|
| "EMERY" 2948 | 100 | 98.6 | — | — |
| "EMERY" 2950 | — | — | 100 | 98 |
| "SILWET" L-77 | — | — | — | 0.5 |
| "SILWET" L-7500 | — | 1.4 | — | 1.5 |
| Panel Coke Test, mg (4 hrs) | 7.4 | 5.9 | 27.3 | 18.2 |

EXAMPLES XVII AND XVIII

The following lubricant compositions were based on "EMERY" 2952 aviation turbine lubricant, a polyol ester based product which meets or exceeds the requirements of Military Specification MIL-L-23699C.

| Composition | Example XVII | XVIII |
|---|---|---|
| "EMERY" 2952 | 100 | 98.0 |
| "SILWET" L-77 | — | 2.0 |
| Panel Coke Test, mg (4 hrs) | 38.8 | 12.1 |

EXAMPLES XIX AND XX

Chain lubricant compositions containing the "SILWET" silicone oil additives were compared with lubricants having commercially available high temperature dispersants and high temperature detergents which are useful in minimizing deposit formation on working surfaces. The dispersant employed was "AMOCO" 9250, an amine type dispersant based on Mannich chemistry. The high temperature detergent was "LUBRIZOL" 930, an overbased barium thiophosphonate. The ISO VG 150 basestock and performance additives for these examples were the same as those used in Examples I and II.

| Composition | Example XIX | XX | I | II |
|---|---|---|---|---|
| Basestock | 96.45 | 96.45 | 96.95 | 96.45 |
| Performance Additives | 3.05 | 3.05 | 3.05 | 3.05 |
| "AMOCO" 9250 | 0.50 | — | — | — |
| "LUBRIZOL" 930 | — | 0.50 | — | — |
| "SILWET" L-77 | — | — | — | 0.50 |
| Panel Coke Test, mg (6 hrs) | 54.7 | 63.6 | 46.4 | 15.9 |
| Appearance: | | | | |
| Clean | — | — | 5 | — |
| Light Varnish | 70 | 25 | 75 | 96 |
| Medium Varnish | — | 20 | — | — |
| Dark Varnish | 5 | 5 | — | — |
| Velvet Carbon | 25 | 50 | 20 | 4 |

EXAMPLES XXI-XXII

The following examples demonstrate the utility of the silicone oils of this invention in reducing deposit formation in a lubricant based on a synthetic diester. The basestock was "EMERY" 2971 Ditridecyl adipate, which had a typical AV of 0.02, an OH of 1.6 and a 40°

C. viscosity of 26.7 cSt. The lubricant compositions and panel coke values are given below. Dioctyldiphenylamine was added as an antioxidant. Butylated triphenylphosphate was added to improve the anti-wear properties of the lubricant composition.

| Composition | Example XXI | Example XXII |
|---|---|---|
| "EMERY" 2971 | 97 | 95 |
| Dioctyldiphenylamine | 2 | 2 |
| Butylated triphenyl-phosphate | 1 | 1 |
| "SILWET" L-7600 | — | 2 |
| Panel Coke Test, mg (4 hrs) | 36.2 | 11.0 |

EXAMPLES XXIII-XXIV

The following examples tested basestocks based on two blends of "EMERY" 2971 Ditridecyl adipate and "EMERY" 3006 Polyalphaolefin. "EMERY" 2971 had the same typical properties as described above. "EMERY" 3006 had a typical AV of <0.01 and 40° C. viscosity of about 30.9 cSt. The dioctyldiphenylamine was utilized as an antioxidant. The 4,4'-methylenebis(2,6-ditert-butylphenol) was added as an antioxidant. The basestock blends had a 40° C. viscosity of about 27.7 cSt. Lubricant compositions and panel coke values are given below.

| Composition | Example XXIII | Example XXIV |
|---|---|---|
| "EMERY" 2971 | 29.7 | 29.1 |
| "EMERY" 3006 | 69.3 | 67.9 |
| Dioctyldiphenylamine | 0.5 | 0.5 |
| 4,4'-methylenebis (2,6-ditert-butylphenol) | 0.5 | 0.5 |
| "SILWET" L-7500 | — | 1.0 |
| "SILWET" L-77 | — | 1.0 |
| Panel Coke Test, mg (4 hrs) | 13.4 | 8.6 |

EXAMPLES XXV-XXVI

Polyalkyleneoxide-modified silicone oil was added to a petroleum-derived lubricant oil to determine the improvement in anti-deposition properties. The petroleum oil was "EXXON" 325 Petroleum, a solvent-extracted neutral oil having an acid value of about 0.02 and a 40° C. viscosity of about 64.8 cSt. 4,4'-methylenebis(2,6-ditert-butylphenol) was added as an antioxidant. The lubricant compositions and panel coke values are given below.

| Composition | Example XXV | Example XXVI |
|---|---|---|
| "EXXON" 325 Petroleum | 99 | 97 |
| 4,4'-methylene bis (2,6-ditert-butylphenol) | 1 | 1 |
| "SILWET" L-7500 | — | 2 |
| Panel Coke Test, mg (4 hrs) | 41.9 | 13.5 |

As the above examples demonstrate, the polyalkyleneoxide-modified silicone oils of the type sold as "SILWET" surface active copolymers provide improved anti-deposition properties in a variety of lubricant compositions. The compositions were based on various esters, polyolefins, blends of esters and polyolefins, and petroleum oil. The lubricants tested had end-uses in chain lubricant applications, but also included lubricants specifically used in compressor and aviation turbine applications. As with other lubricant additives, the amount and specific type of polyalkyleneoxide-modified silicone oil used in a specific composition will depend on the lubricant application as well as the preference of the formulator. Specific types of lubricant compositions have been described, but it is expected that other lubricant basestocks and additives not specifically discussed will nevertheless exhibit improved anti-deposition properties through the use of the silicone oils described herein.

It is apparent that there has been provided, in accordance with the invention, lubricant compositions which fully satisfied the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A lubricant composition having improved anti-deposition characteristics even at temperatures of about 343° C. comprising:

(1) a basestock selected from the group consisting of (a) at least one fluid synthetic ester;

(b) at least one fluid polyolefin;

(c) at least one petroleum-derived lubricant fluid; and (d) mixtures thereof; and (2) a polyalkylene oxide-modified silicone oil of the general formula $$(CH_3)_3SiO[(CH_3)_2SiO]_x(CH_3\underset{\underset{CH_2CH_2CH_2O(EO)_m(PO)_nZ}{|}}{SiO})_ySi(CH_3)_3$$

wherein EO is ethyleneoxy, PO is 1,2-propyleneoxy; Z is either hydrogen or a lower alkyl radical of up to about 5 carbons, $x \geqq 0$, $y \geqq 1$, and m and n are integers, the sum of $m+n$ being at least 1, said silicone oil having a molecular weight in the range of from about 200 to about 5000 g/mole and being present in the lubricant composition in an amount effective to improve said anti-deposition characteristics of said lubricant composition.

2. The lubricant composition of claim 1 wherein said silicone oil has a molecular weight in the range of about 400 to about 1500 g/mole.

3. The lubricant composition of claim 1 wherein said silicone oil comprises about 0.1 to about 3.0% by weight of said composition.

4. A lubricant composition for high temperature applications having improved resistance to deposition even at temperatures of about 343° C. comprising:

(1) a basestock selected from the group consisting of (a) at least one synthetic ester having a 40° C. viscosity in the range of 5 to 300 cSt;

(b) at least one polyolefin having a molecular weight in the range of 250 to 10,000 g/mole; and (c) a blend of said synthetic ester and said polyolefin; and (2) a polyalkylene oxide-modified silicone oil of the general formula $$(CH_3)_3SiO[(CH_3)_2SiO]_x(CH_3SiO)_ySi(CH_3)_3$$
$$\quad\quad\quad $$(CH_3)_3SiO[(CH_3)_2SiO]_x(CH_3\underset{\underset{CH_2CH_2CH_2O(EO)_m(PO)_nZ}{|}}{SiO})_ySi(CH_3)_3$$

wherein EO is ethyleneoxy, PO is 1,2-propyleneoxy, Z is either hydrogen or a lower alkyl radical of up to about 5 carbons, $x \geqq 0$, $y \geqq 1$, and m and n are integers, the sum of $m+n$ being at least 1, and wherein the silicone oil has a molecular weight in the range of from about 200 to about 5000 g/mole.

23. The method of claim 22 wherein said basestock is a basestock for a chain lubricant.

24. The method of claim 22 wherein said silicone oil has a molecular weight in the range of about 400 to about 1500 g/mole.

25. The method of claim 22 wherein said silicone oil is added in an amount of about 0.1 to about 3.0% by weight of the lubricant composition.

26. The method of claim 23 wherein in said silicone oil $n=0$.

* * * * *